US005161692A

United States Patent [19]

Knierim

[11] Patent Number: 5,161,692

[45] Date of Patent: Nov. 10, 1992

[54] OPEN-SIDED CONTAINER APPARATUS

[75] Inventor: Stanley E. Knierim, Indianapolis, Ind.

[73] Assignee: Inland Container Corporation, Indianapolis, Ind.

[21] Appl. No.: 739,695

[22] Filed: Aug. 2, 1991

[51] Int. Cl.[5] ..... B65D 81/02

[52] U.S. Cl. ..... 206/586; 206/320; 229/23 R; 229/125.19

[58] Field of Search ..... 206/320, 386, 586, 453, 206/597, 600; 229/120.13, 120.18, 125.27, 125.31, 23 R, 125.19; 108/51.1, 51.3, 55.1, 55.3, 56.1

[56] References Cited

U.S. PATENT DOCUMENTS

| | | | |
|---|---|---|---|
| 1,200,467 | 10/1916 | Cady | 206/453 |
| 1,639,793 | 8/1927 | Beyer . | |
| 1,691,178 | 11/1928 | Beaman | 229/23 R |
| 2,160,221 | 5/1939 | Masters et al. | 206/586 |
| 2,271,265 | 1/1942 | Kirby | 229/1.5 R |
| 2,474,523 | 6/1949 | Guyer . | |
| 2,474,968 | 7/1949 | Beach, Jr. et al. . | |
| 2,752,032 | 6/1956 | Fish . | |
| 2,779,463 | 1/1957 | Zimmerman . | |
| 2,799,800 | 7/1957 | Sider . | |
| 2,960,217 | 11/1960 | Nason . | |
| 3,143,272 | 8/1964 | Webb et al. . | |
| 3,163,290 | 12/1964 | Shive . | |
| 3,194,395 | 7/1965 | Weaver et al. . | |
| 3,236,437 | 2/1966 | Johnson . | |
| 3,257,768 | 6/1966 | Harrison et al. . | |
| 3,369,652 | 2/1968 | Bebout . | |
| 3,537,635 | 11/1970 | Ress . | |
| 3,543,994 | 12/1970 | Clark | 229/23 R |
| 3,616,986 | 11/1971 | Wolfe . | |
| 3,675,765 | 7/1972 | Melsek . | |
| 3,734,389 | 5/1973 | Brown . | |
| 3,835,986 | 9/1974 | LeBeau | 206/320 |
| 3,843,038 | 10/1974 | Sax | 206/586 |
| 3,891,086 | 6/1975 | Isaacs | 206/320 |
| 3,918,580 | 11/1975 | Poggiali | 206/320 |
| 3,982,682 | 9/1976 | Fremion . | |
| 3,999,658 | 12/1976 | Anderson | 206/320 |
| 4,019,634 | 4/1977 | Bonnot | 206/386 |
| 4,050,604 | 9/1977 | Flanders | 206/600 |
| 4,065,048 | 12/1977 | Pilz, III | 229/125.31 |
| 4,186,834 | 2/1980 | Krack | 206/320 |
| 4,226,327 | 10/1980 | Ballard | 206/320 |
| 4,248,350 | 2/1981 | Gilbert | 206/586 |
| 4,307,805 | 12/1981 | Welch et al. | 206/326 |
| 4,383,609 | 5/1983 | Lochmiller | 206/386 |
| 4,426,034 | 1/1984 | Flanagan | 229/23 BT |
| 4,427,108 | 1/1984 | Coles et al. | 206/44 R |
| 4,429,791 | 2/1984 | Ruppel et al. | 206/454 |
| 4,483,444 | 11/1984 | Gardner | 206/594 |
| 4,610,355 | 9/1986 | Maurer | 206/386 |
| 4,807,804 | 2/1989 | Schwaner et al. . | |
| 4,811,840 | 3/1989 | Myuskens | 206/320 |
| 4,919,270 | 4/1990 | Govang et al. | 206/597 |

FOREIGN PATENT DOCUMENTS

| | | | |
|---|---|---|---|
| 0048454 | 3/1982 | European Pat. Off. . | |
| 1199689 | 8/1965 | Fed. Rep. of Germany . | |
| 2258097 | 5/1974 | Fed. Rep. of Germany . | |
| 0248555 | 12/1987 | Fed. Rep. of Germany | 206/586 |
| 0653178 | 3/1979 | U.S.S.R. | 229/120.18 |

*Primary Examiner*—Jimmy G. Foster
*Attorney, Agent, or Firm*—Fitch, Even, Tabin & Flannery

[57] ABSTRACT

Open-sided container apparatus includes a cap member having an internal divider wall forming pockets for receiving corner posts of L-shaped cross-section. The corner posts have bottom endwalls for cushioning the corners of an appliance. The cap and corner posts may be used separately, if desired.

6 Claims, 2 Drawing Sheets

OPEN-SIDED CONTAINER APPARATUS

BACKGROUND OF THE INVENTION

1. Field of the Invention

The present invention is directed to container apparatus for use with mechanized material handling systems, and in particular, to container apparatus having open sides through which the container contents may be viewed during a handling operation.

2. Description of the Related Art

Despite the increasingly widespread use of non-traditional packaging materials, paperboard containers are oftentimes the most cost effective and easiest to handle, especially in an automated packaging environment. Traditionally, electrical appliances and especially large consumer appliances, such as refrigerators, proceed down an assembly line while resting on a skid or tray-like portion. A collapsible, but rigid, tubular paperboard container having an open bottom end is then telescopically inserted over the top of the appliance and its lower end is secured to the skid to form a completed container assembly enclosing the appliance.

An improved packaging is provided in U.S. Pat. No. 4,807,804, assigned to the assignee of the present invention. The patent describes a tubular carton with closed sidewalls, having a pocket at its upper end for receiving a lifting blade, and has been met with widespread commercial acceptance.

During shipping, appliances are moved from place to place, exposing the container and its contents to possible damage. In some instances, it is desired to inspect the appliances for damage, while in transit to an end user. However, with traditional tubular, closed sidewall paperboard containers, the appliance is obscured from visual inspection. In order to inspect the appliance, the container would have to be opened, leading to possible damage. Further, such inspections are labor intensive.

An alternative container is desired which would allow the appliance to be visually inspected without opening or destroying the container. More specifically, a container having open-sided walls would allow the appliance to be inspected without requiring significant labor. Also, less material is required to construct the open-sided container, thereby reducing the raw material costs.

In traditional tubular paperboard packaging, clearance above the appliance is required to allow lifting of the container above the appliance and telescopically inserting the container over the appliance. It may, however, be desired in some assembly line operations to reserve the clearance space above the appliance for other functions. Thus, it is desirable to provide a container that does not have to be lifted above the appliance, but can be wrapped around the appliance or slid around the appliance.

SUMMARY OF THE INVENTION

It is an object of the present invention to provide a new container apparatus which can be quickly and easily associated with its contents, and in particular, is adapted for use with appliance products.

A further object of the present invention is to provide a carton apparatus which allows the contents to be quickly and easily inspected.

Yet another object of the present invention is to provide carton apparatus having open sides, made from improved components.

These and other objects of the present invention which will become apparent from studying the appended description and drawings are provided in a carton enclosure apparatus comprising a cap member including a top wall with an outer periphery, a skirt wall downwardly depending from said outer periphery so as to form at least two outer corners and cooperating with said top wall to form a partially enclosed area, said cap member further comprising internal divider wall means in said partially enclosed area, extending between said corners and spaced from said skirt wall so as to form channel means therewith for receiving a carton wall member.

BRIEF DESCRIPTION OF THE DRAWINGS

The present invention will be described in connection with the accompanying drawings, which illustrate the preferred embodiments and details of the invention, and in which.

DETAILED DESCRIPTION OF THE PREFERRED EMBODIMENTS

Figure 1:
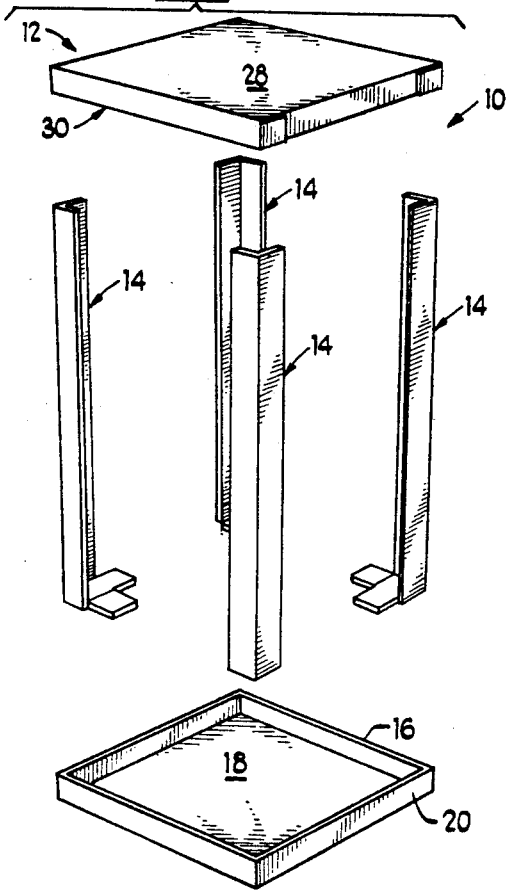
FIG. 1 is an exploded perspective view of a container apparatus embodying principles of the present invention.
Figure 2:
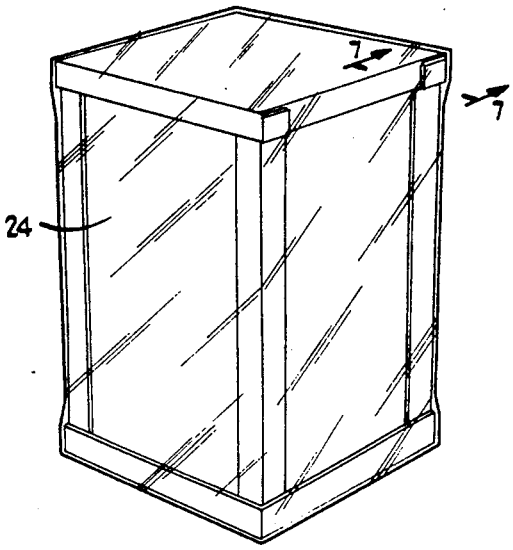
FIG. 2 is a perspective view of the container of FIG. 1, shown with a plastic overwrap.

Referring now to the drawings for purposes of description, but not limitation, an exploded view of a paperboard container apparatus generally indicated at 10, is illustrated in FIG. 1. The container apparatus 10 includes a cap member generally indicated at 12, a plurality of corner posts generally indicated at 14 and a base 16. The base 16 includes a bottom wall 18 and an upstanding sidewall 20. The bottom ends of the corner posts 14 are set inside of the sidewall 20 and are oriented by the corners of the sidewall. As can be seen in FIG. 1, the bottom ends of the corner posts have inturned endwalls which engage the bottom wall 18, increasing the stability of the corner post, and enlarging the contact area with bottom wall 18. As illustrated in FIG. 2, the cap 12 is installed over the upper ends of the corner posts, and is over-wrapped in a plastic material 24.

Figure 3:
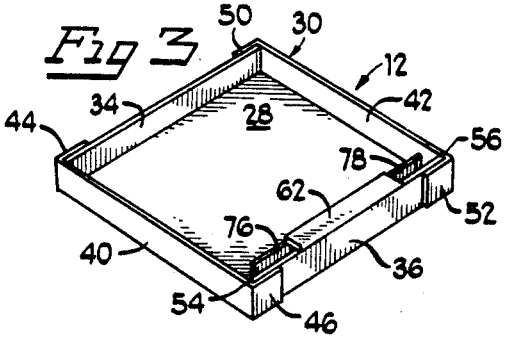
FIG. 3 is a perspective view of the cap of FIGS. 1 and 2, shown in an inverted position.
Figure 4:
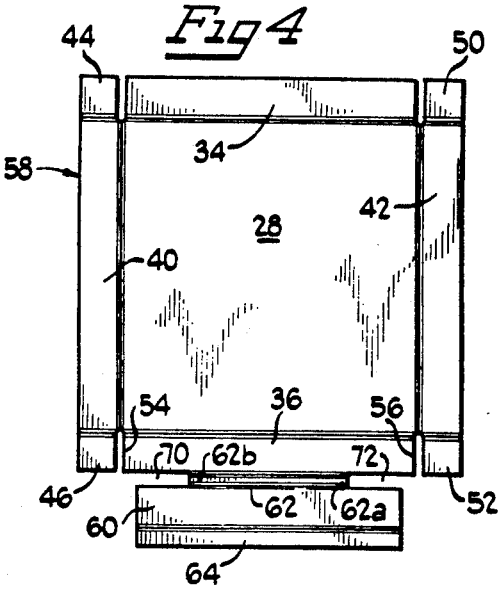
FIG. 4 is a plan view of the blank from which the cap of FIG. 3 may be constructed.

Referring additionally to FIGS. 3 and 4, the cap 12 includes a top wall 28 and a skirt wall generally indicated at 30 downwardly depending from the peripheral edge of top wall 28. The skirt wall 30 and top wall 28 cooperate to define a partially enclosed volume for receiving the upper ends of corner posts 14. The skirt wall 30 includes minor walls 34, 36 and a pair of opposed major walls 40, 42 having end tabs which overlie the minor walls and which are secured thereto with suitable means, preferably adhesive. The major wall 40 includes end tabs 44, 46, while the opposed major wall 42 includes end tabs 50, 52. As can be seen in FIG. 3, the ends 54, 56 of minor wall 36 abut the major sidewalls 40, 42, respectively and thus extend the full width of the cap interior.

Referring now to FIG. 4, a carton blank 58 is folded to form the structure of cap 12, the erection of which is completed with adhesive securement of the end tabs 44, 46, 50, 52 to the minor sidewalls 34, 36. As can be seen in the lower portion of FIG. 4, the blank 58 includes an internal divider wall 60 joined to the free edge of minor wall 36 with a joining or connecting portion 62. An edge wall portion 64 extends from the internal divider wall 60. As can be seen in FIG. 4, the divider wall 60 and edge wall portion 64 are shorter than the minor wall 36, and the connecting portion 62 is significantly shorter than the internal divider wall 60 so as to form slotted openings 70, 72 in the carton blank.

With reference to FIG. 3, the internal divider wall 60, the connecting portion 62 and the edge wall portion 64 are folded in the manner illustrated in FIG. 3 to form a pair of pockets 76, 78 at adjacent corners of the skirt wall, formed at opposite ends of minor wall 36. The connecting portion 62 spaces the divider wall 60 away from minor wall 36, and the spacing is further maintained by edge wall portion 64 which is folded to contact the top wall 28. If desired, the edge wall portion 64 may be secured to top wall 28 by suitable means, such as adhesive.

As mentioned, the internal divider wall 60 is shorter than the minor skirt wall to which it is connected. Accordingly, there is a gap between the ends of the internal divider Wall and the adjacent minor walls 40, 42. This gap communicates with the gaps 76, 78 between the internal divider wall 60 and minor wall 36, so as to form a continuous L-shaped channel at adjacent corners of the cap, for receiving the upper ends of a pair of adjacent corner posts 14.

Figure 5:
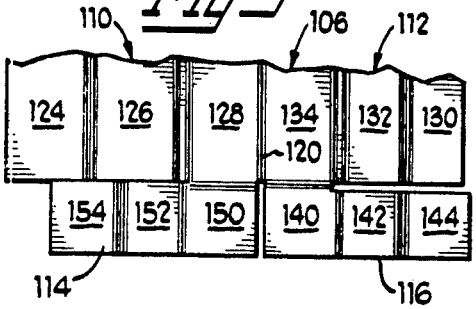
FIG. 5 is a top plan view of a paperboard blank from which the corner post shown in FIGS. 1 and 2 may be constructed.
Figure 6:
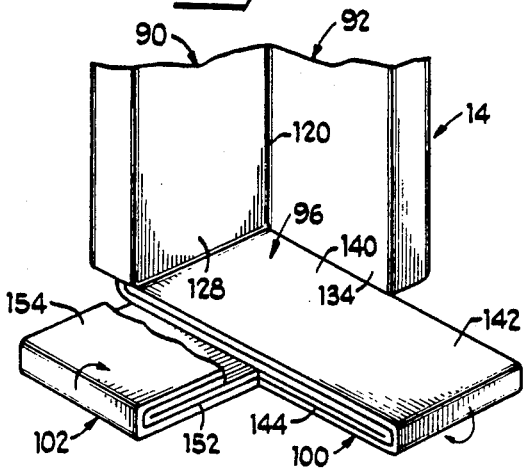
FIG. 6 is a fragmentary perspective view of the corner post of FIGS. 1 and 2.
Figure 11:
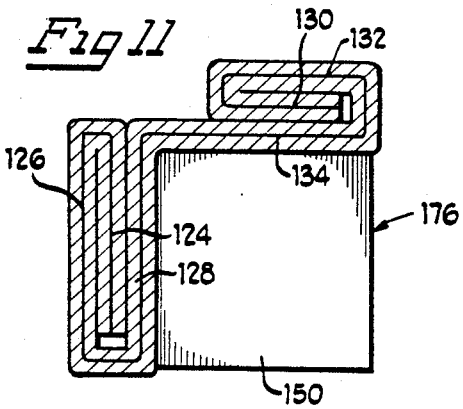
FIG. 11 is a cross-sectional view taken along the line 11—11 of FIG. 10.
Figure 7:
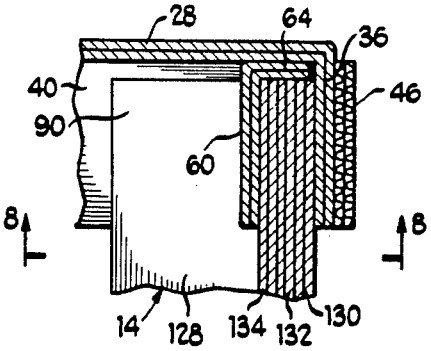
FIG. 7 is a fragmentary cross-sectional view taken along the line 7—7 of FIG. 2.
Figure 12:
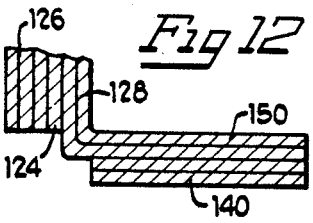
FIG. 12 is a fragmentary cross-sectional view taken along the line 12—12 of FIG. 10.

Referring now to FIGS. 5–8, the corner posts 14 will be described in greater detail. As will become apparent from further description herein, the corner post 14 could be substituted by the corner posts of FIGS. 9–12. Referring to FIG. 6, the corner post 14 has a pair of adjacent sides 90, 92. As will be seen, the sides are preferably formed by folding a paperboard blank so as to have a triple wall thickness. Preferably, the paperboard medium from which the corner posts 14 are constructed has three paper faces, and two corrugated liner portions, alternating with the paper faces.

Referring again to FIG. 6, the corner post 14 includes an in-turned endwall 96, preferably disposed at generally right angles to the sides 90, 92 which are themselves folded at angles, preferably generally right angles to form an L-shaped cross-section of the post. The corner post 14 thereby defines a concave channel closed off at the bottom end by endwall 176 (see FIG. 10). According to one aspect of the present invention, the corner post 14 includes extensions 100, 102 which protrude beyond the endwall 96. In the preferred embodiment, the sides 90, 92 are of generally equal widths, and accordingly, the endwall 96 has a generally square configuration. In use, the corner posts are located at corners of the container contents.

As mentioned, the container apparatus according to principles of the present invention has found immediate practical application for transporting electrical appliances, but of course could be used for virtually any article of merchandise which can be shipped today. It is generally preferred that the corner posts 14 of the container apparatus be placed in direct contact with the corners of the appliance being shipped, and accordingly, the endwalls 96 of the corner posts are located underneath the bottom corners of the appliance. Depending upon the configuration of the appliance corners, (i.e., the degree to which the corners are rounded), only a portion of the endwalls 96 might be engaged by the appliance. Also, an increased cushioning area at the corners of the appliance may be desired. Accordingly, the extensions 100, 102 are provided to further underlie the appliance being shipped in the container apparatus. In the preferred embodiment, the extensions 100, 102 are formed from the same one-piece integral blank 106 as is the remainder of the corner posts 14. Referring to FIG. 5, the carton blank 106 comprises side portions 110, 112 and bottom portions 114, 116. The side portions 110, 112 are joined together at a fold line 120, at the inside corner of the corner post 14. Each side portion 110, 112 is divided into three panels by axially extending fold lines, extending along the axis of blank 106. Referring to side portion 110 of the blank, the outermost panel 124 is folded against the medial panel 126, so as to be located between panels 124, 128.

Figure 8:
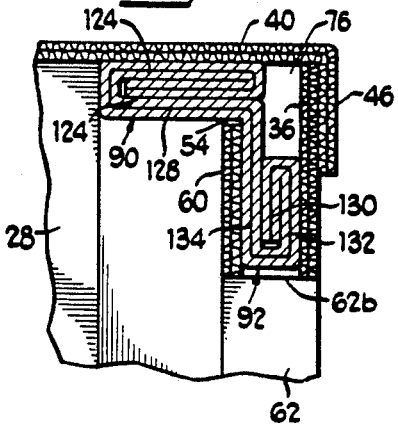
FIG. 8 is a fragmentary cross-sectional view taken along the line 8—8 of FIG. 7.

Referring to the opposed side portion 112 of the blank, the outermost panel 130 is folded against intermediate panel 132 which in turn is folded so as to bring panel 130 between panels 132, 134, as illustrated in FIG. 8. As can be seen in FIG. 8, side 92 is located between internal divider wall 60, minor skirt wall 36, and one end edge 62*b* of connecting portion 62. The remaining leg 90 of the corner post is positioned between the end edge 54 of internal divider wall 60 and skirt wall 40. However, the side 90 of the corner post is securely retained since the end edge 54 of the internal divider wall 60 is located immediately adjacent the inside corner of the corner post.

Referring again to FIG. 5, the bottom portion 116 of blank 106 is comprised of a foldably connected series of three panels 140, 142 and 144. The innermost panel 140 comprises an endwall panel which forms the exposed surface of endwall 96, as can be seen in FIG. 6. The intermediate panel 142 and the end panel 144 together comprise the extension 100 with panel 144 being folded under panel 142. Thus, with respect to bottom portion 116, the endwall 96 has a single thickness, whereas the extension 100 has a double thickness.

Referring again to FIG. 5, the bottom portion 114 of blank 106 is divided by fold line into three foldably connected panels 150–154. The inner most panel 150 comprises an endwall panel which underlies the aforementioned panel 140, cooperating with panel 140 to provide a double thickness to endwall 96, comprised of the combination of panels 140, 150. The extension 102 is comprised of the overlying combination of panels 152, 154, panel 154 being folded on top of panel 152, as shown in FIG. 6. Thus, as will now be appreciated, the endwall 96 and the extensions 100, 102 protruding therefrom each have a double thickness of paperboard blank material. Accordingly, the corner posts 14 provide a significant cushioning area for the corners of the appliance, where other contents are carried within the container apparatus.

Figure 9:
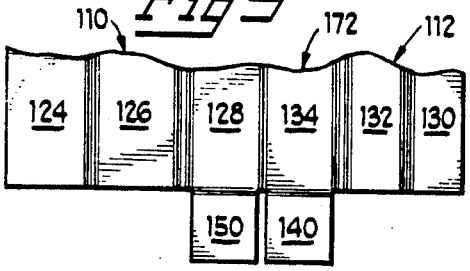
FIG. 9 is a fragmentary plan view of a paperboard blank from which an alternative corner post may be constructed.
Figure 10:
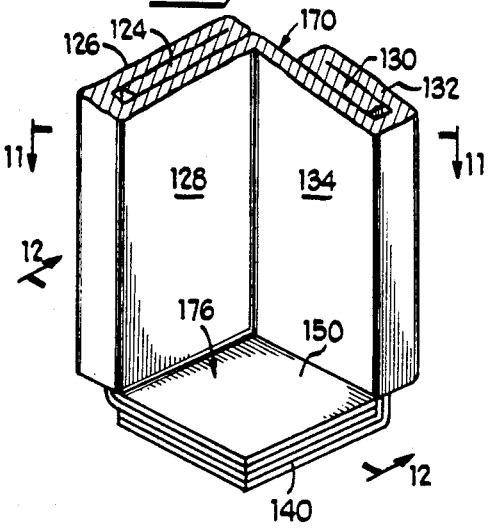
FIG. 10 is a fragmentary perspective view of the corner post made from the blank of FIG. 9.

Turning now to FIGS. 9–12, an alternative embodiment of a corner post constructed according to principles of the present invention will now be described. The corner post 170 is substantially identical to the aforedescribed corner post 14, except for the omission of the extensions 100, 102. FIG. 9 shows the paperboard blank 172 from which a corner post 170 is formed. The side portions of corner post 170 are identical to those of the corner post 14 described above, and the same reference numerals are used to describe the panel components of each side portion 110, 112 of the blank 172. The blank 172 does however differ from the aforedescribed blank 106 in the bottom portions thereof which comprise the two panels 140, 150. As can be seen in FIG. 10, the endwall 176 of corner post 170 comprises the overlying joinder of panels 140, 150, preferably secured together by adhesive or other suitable means. The corner post 170 may be preferred where weight savings are important, and where cushioning at the corners of the appliance are not required or where the appliance corners are relatively sharp, so as to overlie substantial portions of the corner post endwalls 176.

As will now be apparent from the above description, the cap and corner post may be employed alone in a container apparatus. For example, the cap could be used with corner posts of L-shaped cross-section different from the corner posts described herein and could be used as the upper closure member of a "shrink-wrapped" container such as that illustrated in FIG. 2, or may be employed as an insert within a closed wall tubular container or container of other configuration. Likewise, the corner posts 14 or 170 described above need not be used with the see-through shrink wrap container of FIG. 2, but could be employed as internal components of other container arrangements.

Further, both sides of corner posts 14, 170 could be used in the same container arrangement where weight savings, costs reductions or appliance configurations require the omission of the extensions 100, 102 at some of the corners of the appliance. As a further alternative arrangement, the panels 152, 154 could be omitted from blank 106 or the panels 142, 144 could be removed from that blank, selectively, to provide a single extension from the endwall 96 of corner post 14, as may be desired for a particular container arrangement.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. Carton apparatus, comprising: a cap member including a top wall with an outer periphery, a skirt wall downwardly depending from said outer periphery so as to form at least two outer corners and cooperating with said top wall to form a partially enclosed area, said cap member further comprising internal divider wall means in said partially enclosed area, extending between said corners and spaced from said skirt wall so as to form channel means therewith for receiving a carton wall member; and a plurality of corner posts, each comprising a one-piece integral paperboard blank of preselected thickness folded to form a corner post including a pair of coextensive sides joined together at an angle to one another along an axially extending fold line so as to form a concave channel, and end wall means interrupting said concave channel, comprising a pair of overlapping end walls, one extending from each side, respectively.

2. The apparatus of claim 1 further comprising a joining wall joining said internal divider wall means and said skirt wall with said joining wall extending generally parallel to said skirt wall and dimensioned shorter than the distance between said corners, so as to cooperate with said skirt wall to define a pair of channels extending along said skirt wall.

3. The apparatus of claim 1 wherein said internal divider wall means has a free edge adjacent said top wall, said apparatus further comprising edge wall means joined to said internal divider wall means with a fold line and positioned at least immediately adjacent said top wall means.

4. The apparatus of claim 1 wherein said endwall means further comprises a series of foldably connected panels foldably connected to each of said endwalls, each series of foldably connected panels having at least one pair of panels folded one on top of another to form an endwall extension of multiple paperboard thicknesses.

5. Carton enclosure apparatus including a cap member, comprising:

a top wall with an outer periphery;

at least one skirt wall downwardly depending from said outer periphery so as to form at least two outer corners and cooperating with said top wall to form a partially enclosed area;

an internal divider wall in said partially enclosed area, extending between said corners and spaced from and generally parallel to said at least one skirt wall so as to define a channel between said internal divider wall and said skirt wall; and a joining wall joining said internal divider wall and said at least one skirt wall, said joining wall extending between first portions of said internal divider wall and said at least one skirt wall so as to divide said channel into downwardly opening pocket portions for telescoping engagement with an end of a carton wall member, the pocket portions extending between said joining wall and said outer corners and between remaining portions of said internal divider wall and said at least one skirt wall.

6. The apparatus of claim 5 further comprising an edge portion joined to said internal divider wall with a fold line for overlapping engagement with said top wall.

* * * * *